US010955777B2

(12) United States Patent
Saitoh et al.

(10) Patent No.: US 10,955,777 B2
(45) Date of Patent: Mar. 23, 2021

(54) FIXING DEVICE INCLUDING AT LEAST ONE TEMPERATURE DETECTOR AND A DEVICE-SIDE CONNECTOR AND IMAGE FORMING APPARATUS INCLUDING SAME

(71) Applicants: Seiji Saitoh, Kanagawa (JP); Toshiharu Hachisuka, Kanagawa (JP); Hiroshi Seo, Kanagawa (JP); Yutaka Naitoh, Kanagawa (JP); Daisuke Inoue, Tokyo (JP); Masao Katoh, Kanagawa (JP); Yutaka Aso, Kanagawa (JP); Naohiro Funada, Kanagawa (JP); Tomoo Asami, Kanagawa (JP); Jun Okamoto, Tokyo (JP)

(72) Inventors: Seiji Saitoh, Kanagawa (JP); Toshiharu Hachisuka, Kanagawa (JP); Hiroshi Seo, Kanagawa (JP); Yutaka Naitoh, Kanagawa (JP); Daisuke Inoue, Tokyo (JP); Masao Katoh, Kanagawa (JP); Yutaka Aso, Kanagawa (JP); Naohiro Funada, Kanagawa (JP); Tomoo Asami, Kanagawa (JP); Jun Okamoto, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/750,043

(22) Filed: Jan. 23, 2020

(65) Prior Publication Data

US 2020/0241452 A1 Jul. 30, 2020

(30) Foreign Application Priority Data

Jan. 25, 2019 (JP) ..... 2019-011129

(51) Int. Cl.
*G03G 15/00* (2006.01)
*G03G 15/20* (2006.01)

(52) U.S. Cl.
CPC ..... *G03G 15/2039* (2013.01)

(58) Field of Classification Search
CPC ..... G03G 15/2039; G03G 21/1642; G03G 21/1652; G03G 21/1647; G03G 21/1685
(Continued)

(56) References Cited

U.S. PATENT DOCUMENTS 6,104,889 A 8/2000 Saitoh
8,498,547 B2 * 7/2013 Mitsuoka et al. . G03G 15/2039 399/69

(Continued)

FOREIGN PATENT DOCUMENTS

JP 2007-034044 2/2007
JP 2010-072073 4/2010

(Continued)

OTHER PUBLICATIONS

U.S. Appl. No. 16/391,959, filed Apr. 23, 2019, Takamasa Hase, et al.

*Primary Examiner* — William J Royer
(74) *Attorney, Agent, or Firm* — Harness, Dickey & Pierce, P.L.C.

(57) ABSTRACT

A fixing device includes at least one temperature detector and a device-side connector. The at least one temperature detector is configured to detect a temperature of the fixing device. The device-side connector is configured to transmit a temperature detection signal from the at least one temperature detector to an image forming apparatus body by mutual contact between a terminal of the device-side connector and a terminal of a body-side connector of the image forming apparatus body. A lead wire of the at least one temperature detector is branched into a plurality of wires connected to the device-side connector.

15 Claims, 18 Drawing Sheets

(58) Field of Classification Search
USPC ..... 399/69, 90, 122
See application file for complete search history.

(56) References Cited

U.S. PATENT DOCUMENTS

| | | | | |
|---|---|---|---|---|
| 9,274,473 | B2 * | 3/2016 | Mogi ..... | G03G 15/2053 |
| 9,367,006 | B2 * | 6/2016 | Yoshida et al. .... | G03G 15/2053 |
| 10,788,775 | B2 * | 9/2020 | Okamoto et al. .. | G03G 21/1685 |
| 2006/0239707 | A1 | 10/2006 | Saitoh | |
| 2011/0064440 | A1 | 3/2011 | Saitoh | |
| 2015/0220029 | A1 | 8/2015 | Samei et al. | |
| 2016/0274510 | A1 | 9/2016 | Hase et al. | |

FOREIGN PATENT DOCUMENTS

| | | |
|---|---|---|
| JP | 2014-225374 | 12/2014 |
| JP | 2017-049283 | 3/2017 |

* cited by examiner

FIXING DEVICE INCLUDING AT LEAST ONE TEMPERATURE DETECTOR AND A DEVICE-SIDE CONNECTOR AND IMAGE FORMING APPARATUS INCLUDING SAME

CROSS-REFERENCE TO RELATED APPLICATIONS

This patent application is based on and claims priority pursuant to 35 U.S.C. § 119(a) to Japanese Patent Application No. 2019-011129, filed on Jan. 25, 2019, in the Japan Patent Office, the entire disclosure of which is incorporated by reference herein.

BACKGROUND

Technical Field

The present disclosure relates to a fixing device and an image forming apparatus including the fixing device.

Related Art

In a fixing device of an image forming apparatus, it is necessary to attach/detach the fixing device to/from an image forming apparatus body in order to solve a paper jam problem, perform maintenance for components inside the fixing device, and replace the fixing device. The fixing device includes a heating member, a temperature detection member, a setting detection member that detects presence/absence of the fixing device, and the like. Therefore, electrical connection may be necessary to: supply electric power to the heating member from the apparatus body; and transmit a temperature detection signal. To achieve the electrical connection, it is known to use a drawer connector that easily connects/disconnects these members at the time of attaching/detaching the fixing device to/from the apparatus body. The drawer connector includes an electrical contact with the image forming apparatus body in order to supply the electric power to an electrical system including the heating member, the temperature detection member of the fixing device, and the like.

In the fixing device including the drawer connector that connects a signal wire of a temperature detector of the detachable fixing device to the image forming apparatus body, various kinds of failure may occur due to the following reasons. When the fixing device is attached/detached, gold plating on a terminal surface layer at a terminal portion of the drawer connector is peeled off by sliding motions of the fixing device, and nickel plating on an underlying layer is exposed and subjected to a high-temperature and high-humidity environment because of the location in the vicinity of the fixing device. As a result, a nickel oxide is generated, defective contact occurs at a contact portion, and a temperature detection signal is not transmitted correctly. If the defective contact occurs due to the nickel oxide, the contact portion acts extremely unstably. For example, contact resistance is momentarily changed or the contact portion comes to have an intermediate resistance value. However, in most cases, resistance increase is not continuous, and the resistance returns to a normal state by slight vibration or attachment/detachment of the fixing device.

SUMMARY

In an aspect of the present disclosure, a fixing device includes at least one temperature detector and a device-side connector. The at least one temperature detector is configured to detect a temperature of the fixing device. The device-side connector is configured to transmit a temperature detection signal from the at least one temperature detector to an image forming apparatus body by mutual contact between a terminal of the device-side connector and a terminal of a body-side connector of the image forming apparatus body. A lead wire of the at least one temperature detector is branched into a plurality of wires connected to the device-side connector.

In another aspect of the present disclosure, an image forming apparatus includes the fixing device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
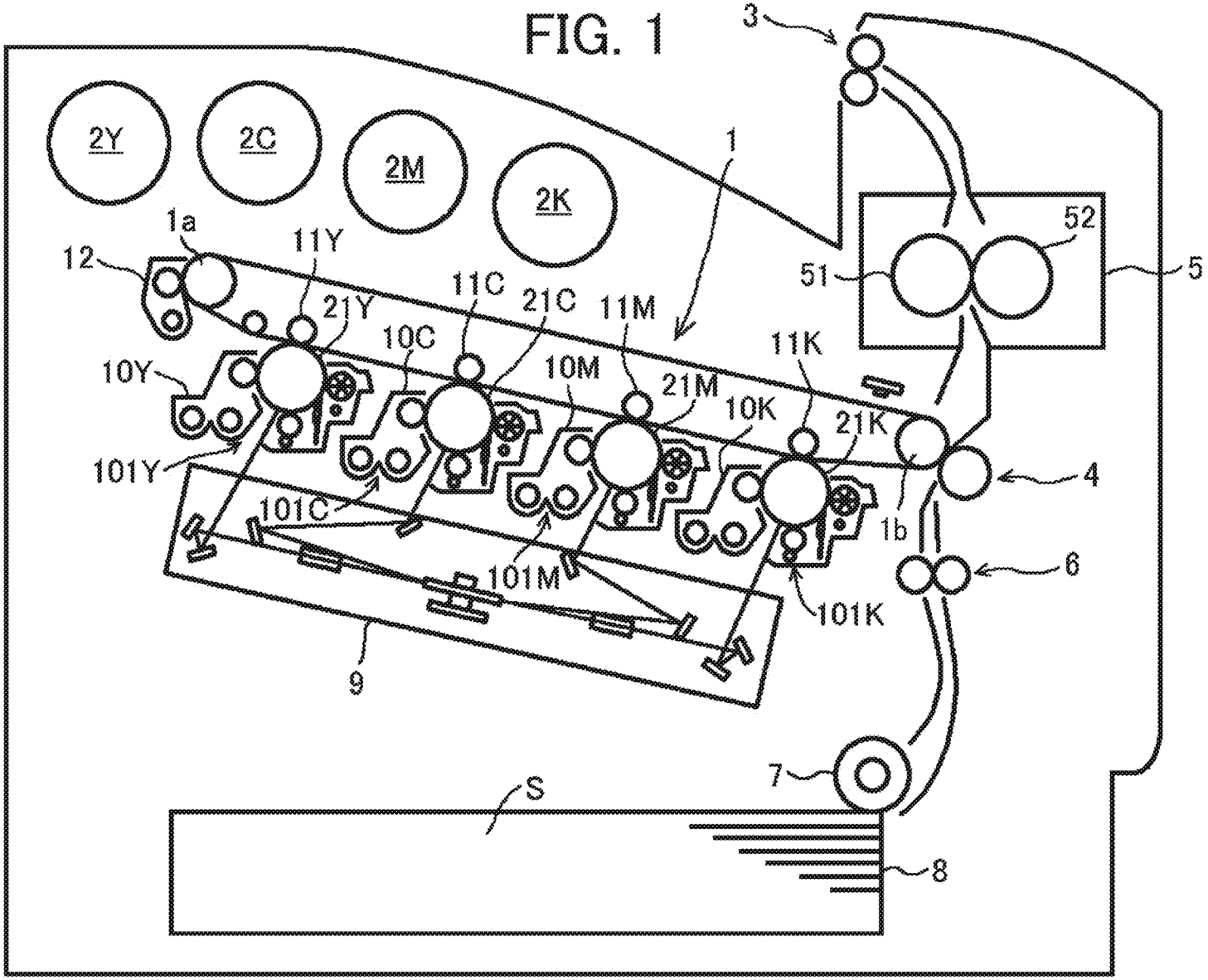
FIG. 1 is a schematic configuration view of a printer according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a color laser printer (hereinafter also simply referred to as a "printer") that is an image forming apparatus according to an embodiment of the present disclosure will be described. FIG. 1 is a schematic configuration view of the printer according to the present embodiment. This printer includes a tandem image former including four image forming devices of yellow, cyan, magenta, and black which are arranged side by side. In the tandem image former, image forming devices 101Y, 101C, 101M, and 101K as individual toner image forming devices are sequentially arranged from the left in the drawing. Here, suffixes Y, C, M, and K of the respective reference signs represent members of yellow, magenta, cyan, and black, respectively. Additionally, the individual image forming devices 101Y, 101C, 101M, and 101K of the tandem image former include charging devices, developing devices 10Y, 10C, 10M, and 10K, photoconductor cleaning devices, and the like which are arranged respectively around drum-shaped photoconductors 21Y, 21C, 21M, and 21K as latent image bearers. The printer includes, in an upper portion of the printer, toner bottles 2Y, 2C, 2M, and 2K respectively filled with toner of the respective colors of yellow, cyan, magenta, and black. The developing devices 10Y, 10C, 10M, and 10K are supplied with predetermined supply amounts of the toner respectively from the toner bottles 2Y, 2C, 2M, and 2K through conveyance paths provided in the image forming apparatus.

Additionally, an optical writing unit 9 as a latent image forming device is provided below the tandem image former. The optical writing unit 9 includes a light source, a polygon mirror, an f-θ lens, a reflection mirror, and the like, and irradiates the surfaces of the respective photoconductors 21Y, 21C, 21M, and 21K with laser light while scanning the surfaces with the laser light based on image data.

Additionally, an intermediate transfer belt 1 having an endless belt type is provided as an intermediate transferor immediately above the tandem image former. The intermediate transfer belt 1 is passed around support rollers 1*a* and 1*b*, and a drive motor as a driving source is connected to a rotation shaft of the support roller 1*a* functioning as a drive roller among the support rollers. When this drive motor is driven, the intermediate transfer belt 1 is rotationally moved in a counterclockwise direction in the drawing, and also the support roller 1*b* that can be driven is rotated. The intermediate transfer belt 1 includes, on an inner side of the intermediate transfer belt, primary transfer devices 11Y, 11C, 11M, and 11K to transfer, onto the intermediate transfer belt 1, the toner images on the photoconductors 21Y, 21C, 21M, and 21K.

Additionally, the intermediate transfer belt 1 includes a secondary transfer roller 4 as a secondary transfer device more on a downstream side than the primary transfer devices 11Y, 11C, 11M, and 11K in the driving direction of the intermediate transfer belt 1. The support roller 1*b* is arranged on an opposite side of the secondary transfer roller 4 while interposing the intermediate transfer belt 1, and functions as a pressing member. Additionally, a sheet tray 8, a sheet feeding roller 7, a registration roller 6, and the like are provided. Further provided are a fixing device 5 and an output roller pair 3 at a downstream portion of the secondary transfer roller 4 in an advancing direction of a recording medium S on which the toner image has been transferred by the secondary transfer roller 4. The fixing device 5 fixes the image on the recording medium S.

Next, operation of the printer will be described. The photoconductors 21Y, 21C, 21M, and 21K are respectively rotated in the individual image forming devices 101Y, 101C, 101M, and 101K, and the surfaces of the photoconductors 21Y, 21C, 21M, and 21K are first uniformly charged by the charging devices along with the rotation of the photoconductors 21Y, 21C, 21M, and 21K. Subsequently, writing laser light is emitted from the optical writing unit 9 based on image data to form electrostatic latent images on the photoconductors 21Y, 21C, 21M, and 21K. After that, the toner is made to adhere by the developing devices 10Y, 10C, 10M, and 10K to visualize the electrostatic latent images, thereby forming respective monochromatic images of yellow, cyan, magenta, and black on the respective photoconductors 21Y, 21C, 21M, and 21K. Additionally, the support roller 1*a* as the drive roller is rotationally driven by the drive motor provided in the image forming apparatus to rotationally drive the support roller 1*b* as the driven roller and the secondary transfer roller 4 and rotationally convey the intermediate transfer belt 1. Then, the visible images are sequentially transferred onto the intermediate transfer belt 1 at the primary transfer devices 11Y, 11C, 11M, and 11K. Thus, a composite color image is formed on the intermediate transfer belt 1. The surfaces of the photoconductors 21Y, 21C, 21M, and 21K after the image transfer have residual toner removed by the respective photoconductor cleaning devices to prepare for image formation again.

Further, a leading edge of the recording medium S is fed out from the sheet tray 8 by the sheet feeding roller 7, conforming to timing of image formation. Then, the recording medium S is conveyed to the registration roller 6 and stopped temporarily. Subsequently, the recording medium S is conveyed between the secondary transfer roller 4 and the intermediate transfer belt 1, conforming to the timing of image forming operation. Here, the intermediate transfer belt 1 and the secondary transfer roller 4 form a so-called secondary transfer nip while sandwiching the recording medium S, and the toner image on the intermediate transfer belt 1 is secondarily transferred onto the recording medium S at the secondary transfer roller 4.

The recording medium S after the image transfer is sent to the fixing device 5, and the recording medium S is conveyed and nipped at a nip portion formed by a fixing rotator 51 having a surface kept at a predetermined temperature and a pressure rotator 52 facing the fixing rotator 51 and pressed against the fixing rotator 51. Thus, the toner image on the recording medium S is heated, pressurized, and fixed on the recording medium S. Furthermore, the recording medium S ejected from the nip portion is separated by a separator and then ejected from the output roller pair 3 to the outside of the apparatus. On the other hand, the intermediate transfer belt 1 after the image transfer has residual toner remaining on the intermediate transfer belt 1, and the residual toner is removed by an intermediate transferor cleaning device 12 to prepare again for image formation by the tandem image former.

Figure 2:
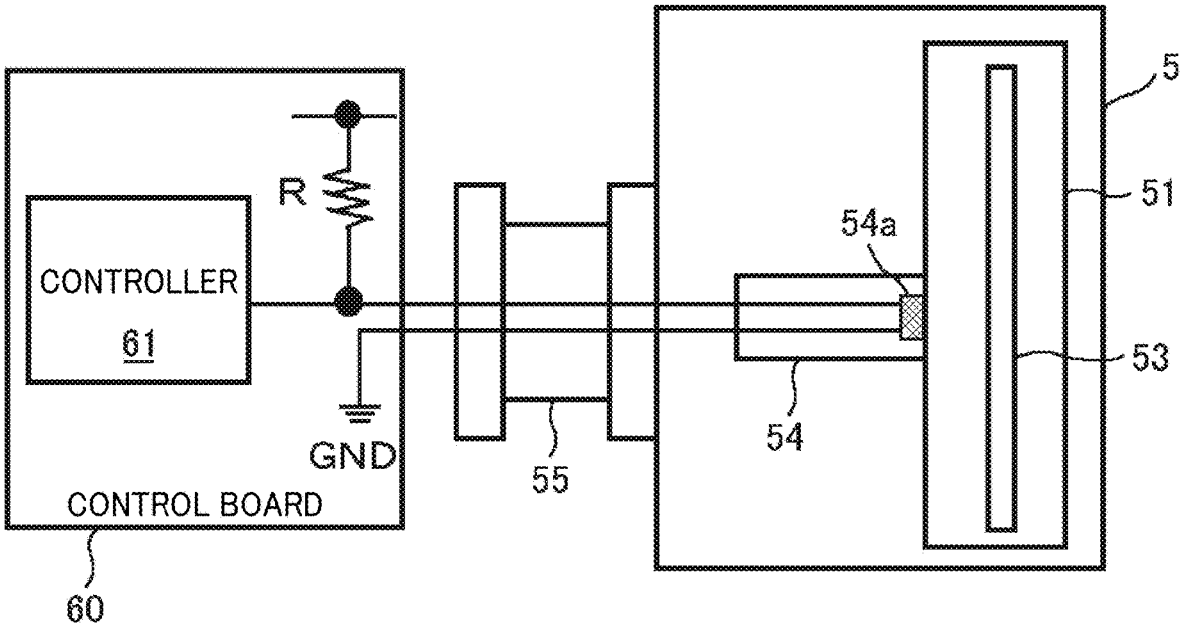
FIG. 2 is a diagram illustrating an exemplary temperature detection circuit of a fixing device according to the embodiment.

FIG. 2 is a diagram illustrating an exemplary temperature detection circuit of the fixing device 5 according to the embodiment. The fixing device 5 includes a temperature detector 54. The temperature detector 54 detects a temperature of the fixing device 5 and includes a thermistor element 54*a* in which a resistance value is changed by the temperature. The temperature detector 54 detects the temperature of the fixing rotator 51 based on the change in the resistance value. Here, a thermistor is used as the temperature detector 54, but the temperature detector 54 is not limited to the thermistor. The temperature detector 54 has current flowing from a controller 61 of a control board 60 via a drawer connector 55. The controller 61 detects voltage that is changed by the resistance change at the thermistor element 54*a*, and controls energization of a heating member 53 to control the temperature of the fixing rotator 51.

The drawer connector 55 includes a pair of male and female connectors, and when these connectors are inserted, energization is achieved by mutual contact between terminal portions provided at the respective connectors. Assuming that the drawer connector 55 is inserted/removed a large number of times, a terminal for a signal wire generally has a surface including a base material of copper and applied with nickel plating, and the nickel-plated surface is further applied with gold plating.

The gold plating on a terminal surface layer at a contact portion of the drawer connector 55 inside the temperature detection circuit may be peeled off, and the nickel plating on an underlying layer may be exposed and subjected to a high-temperature and high-humidity environment due to the location in the vicinity of the fixing device 5. As a result, a nickel oxide and an oxide coating may be generated. Also, dust or foreign matters may enter the contact portion, and defective contact may be caused due to the dust or foreign matters.

In a case where such defective contact occurs at the contact portion and a temperature detection signal cannot be correctly transmitted, a temperature higher or lower than a proper detection temperature is detected. In a case where a high temperature is erroneously detected, the temperature of the fixing device 5 is controlled to be a temperature lower than a proper target temperature, a toner image is defectively fixed on a recording medium, and image quality is degraded. Additionally, in a case where a lower temperature is erroneously detected, the temperature of the fixing device 5 is controlled to be a temperature higher than the proper target temperature. Therefore, there may be a disadvantage of accelerating deterioration of the fixing device 5. In a case of having such a malfunction state, a user or service person may need to detach the fixing device 5 once, and perform cleaning work. Furthermore, in a case where such a malfunction state is not solved by the cleaning work, the fixing device 5 must be replaced.

Figure 3:
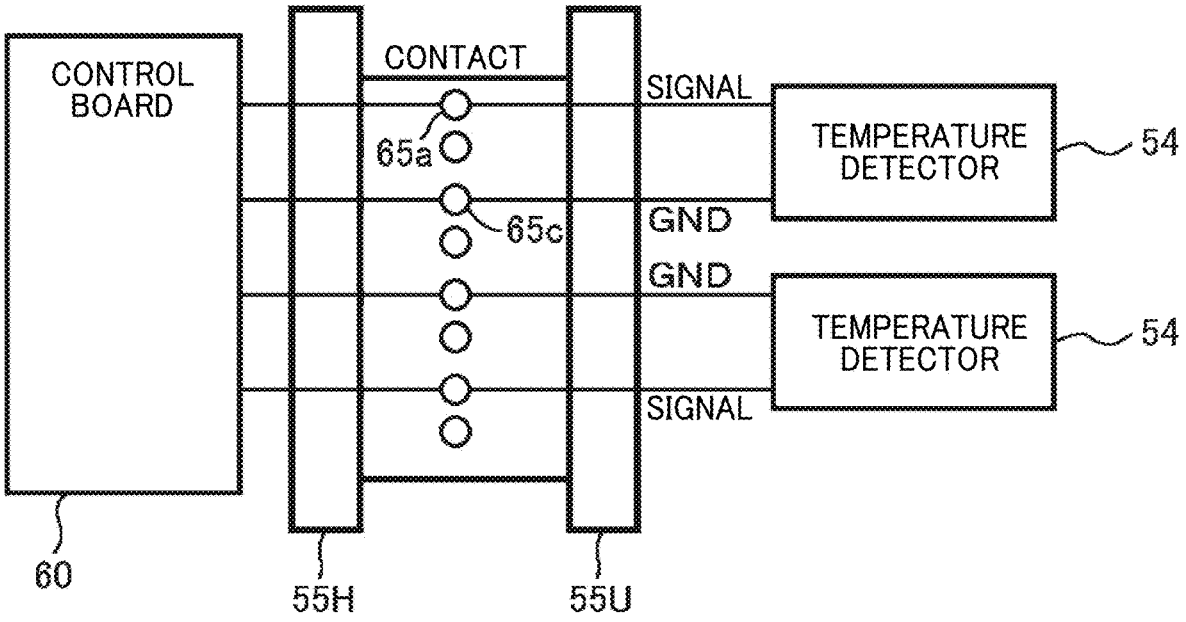
FIG. 3 is a diagram illustrating a temperature detection circuit according to a comparative example in which contacts of a drawer connector are schematically illustrated.

FIG. 3 is a diagram of a temperature detection circuit according to a comparative example in which contacts of a drawer connector are schematically illustrated. The drawer connector 55 of FIG. 2, includes a device-side connector 55U and a body-side connector 55H as shown in FIG. 3, and is arranged between the temperature detector 54 and the control board 60 of an apparatus body. The device-side connector 55U is installed in the fixing device 5, and the body-side connector 55H is installed in an image forming apparatus body. Generally, a thermistor as a temperature detector includes two lead wires, and the lead wires are separated into a signal wire and a ground (GND) wire (earth wire). The lead wires of the temperature detector 54 are connected to the device-side connector 55U. There is a terminal at an end of each lead wire, and a place where a terminal of the body-side connector 55H and a terminal of the device-side connector 55U are in contact with each other is a contact. Temperature detection current flows from a signal side of the control board 60 to a signal side of the temperature detector 54 via a contact 65*a* of the drawer connector 55, and flows through a thermistor element 54*a* (not illustrated in FIG. 3), and then again flows to the control board 60 via another contact 65*c* of the drawer connector 55 from the GND side of the temperature detector 54.

Here, when resistance at any contact (e.g., contact 65*a*) of the drawer connector 55 is increased, other resistance is added to the temperature detection circuit. Therefore, a temperature cannot be correctly detected, and detection cannot be performed correctly, and the above-described failure occurs.

Figure 4:
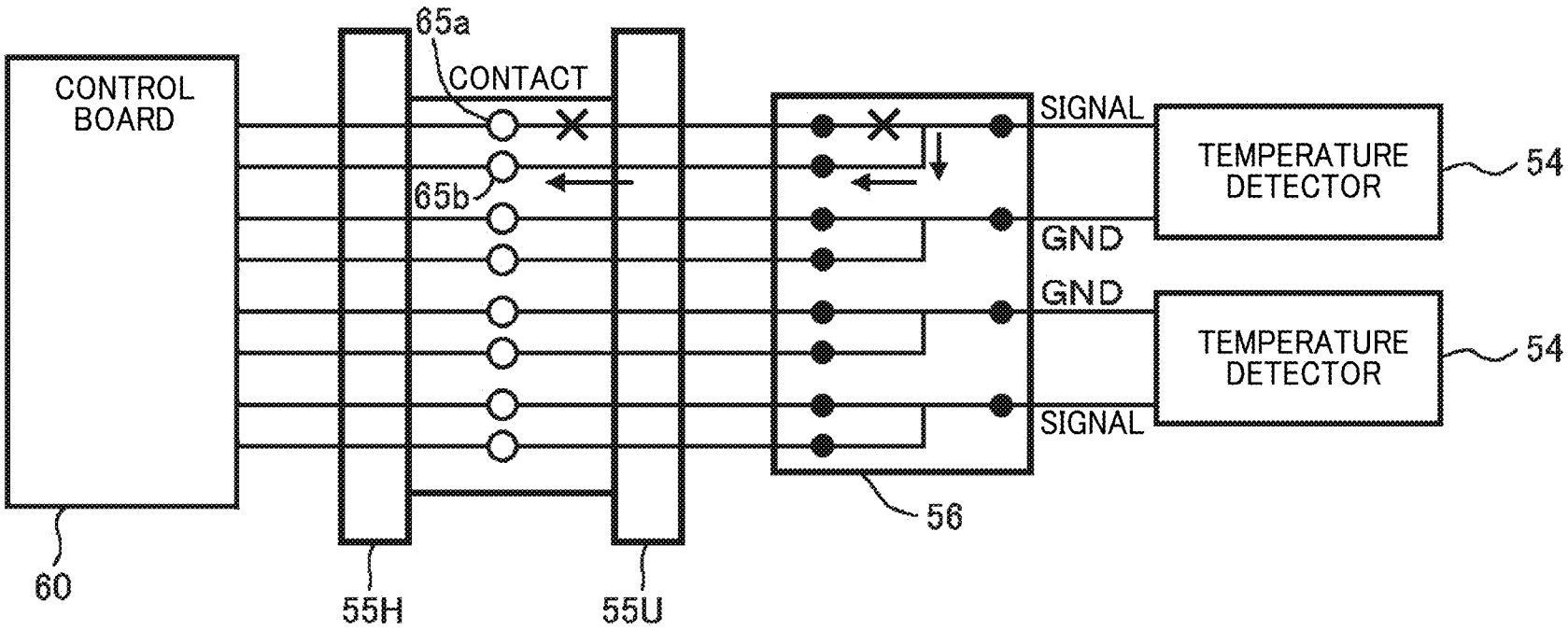
FIG. 4 is a diagram illustrating a temperature detection circuit according to an embodiment of the present disclosure, in which contacts of a drawer connector are schematically illustrated.

FIG. 4 is a diagram illustrating a temperature detection circuit according to an embodiment of the present disclosure, in which contacts of the drawer connector 55 of FIG. 2, including the device-side connector 55U and a body-side connector 55H are schematically illustrated. This temperature detection circuit is an example in which a relay board 56 is used to increase the number of wires to a plurality of wires. Specifically, the relay board 56 is arranged between the temperature detector 54 and the drawer connector 55, noted by the device-side connector 55U and a body-side connector 55H in FIG. 4. The signal wire and the GND wire, which are the lead wires from the temperature detector 54, are connected to the relay board 56 on the signal side and the GND side respectively, and the lead wires are branched into two signal wires and two GND wires respectively (in other words, the number of wires is increased to a plurality of wires), and then connected to the control hoard 60 through the drawer connector 55. Each of the lead wires of the temperature detector 54 is branched into the plurality of wires by pattern wiring on the relay board 56. Use of the relay board 56 enables use of the drawer connector 55 that is a versatile drawer connector as having been conventionally used. Therefore, the drawer connector 55 can be procured at a low cost. A temperature detection signal is transmitted to the controller 61 (shown in FIG. 2) in the control board 60 as one signal by pattern wiring in the control board 60. Alternatively, a relay hoard or a relay connector may also be used on the apparatus body side to revert the two lead wires to one lead wire. Additionally, one or a plurality of temperature detectors 54 may be provided in the fixing device 5.

As described above, the fixing device 5 according to the present embodiment includes: one or a plurality of temperature detectors 54 that detects a temperature of the fixing device 5; and the device-side connector 55U that transmits a temperature detection signal from the temperature detector 54 to the image forming apparatus body by mutual contact between the terminal of the device-side connector 55U and the terminal of the body-side connector 55H. The lead wire of each temperature detector 54 is branched into a plurality of wires in parallel and connected to the device-side connector 55U. With this configuration, the temperature detection signal can be correctly transmitted even in occurrence of defective contact at a contact of the connector that connects the lead wire of the temperature detector 54 of the detachable fixing device 5 to the image forming apparatus body. Furthermore, it is possible to prevent occurrence of failure that accompanies the defective contact.

Figure 5:
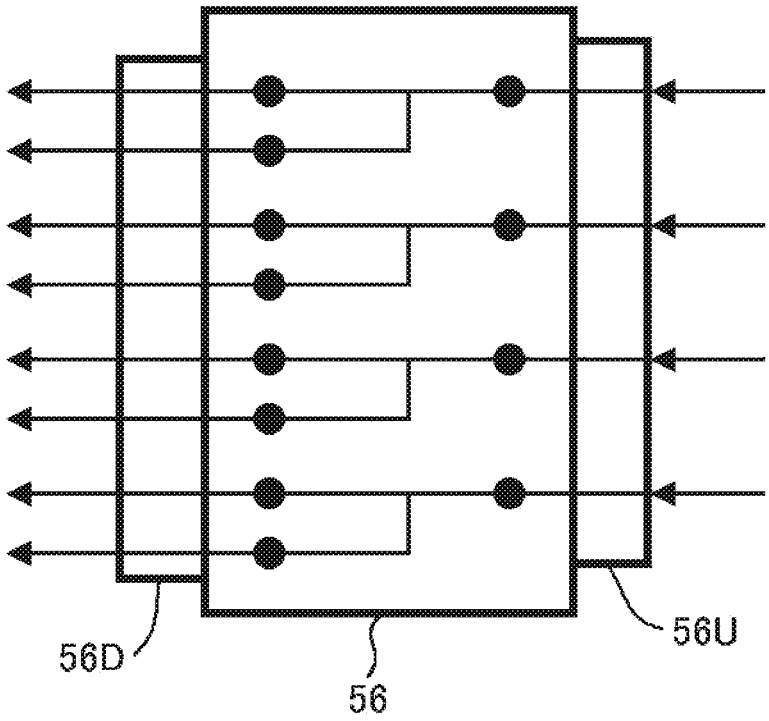
FIG. 5 is a diagram illustrating branching of a signal wire in a relay board.

Next, branching of a lead wire in the relay board 56 will be described with reference to FIG. 5. FIG. 5 is a schematic enlarged diagram of the relay board 56 illustrated in FIG. 4. One lead wire from the temperature detector 54 is directly connected to the relay board 56 as one lead wire via a relay connector 56U. Then, a signal wire and a GND wire are lead wires of each temperature detector 54, and each of these wires is branched from one wire to two wires by the pattern wiring in the relay board 56. The number of each of these wires is increased to a plurality of wires, and the wires are arranged in parallel. The signal wires and the GND wires obtained by doubling the respective wires are connected to the drawer connector 55 via a relay connector 56D. The relay board 56 includes the relay connector 56U and the relay connector 56D. Note that the increasing number of wires to the plurality of wires is not limited to double and may be three times or more.

Referring back to FIG. 4 again, a case where resistance at one contact of the drawer connector 55 of FIG. 4 is increased will be described. Similar to the case of FIG. 3, since the number of signal wires is increased to the plurality of wires and arranged in parallel, in the case where the resistance at the one contact 65*a* illustrated in FIG. 4 is increased, current flows to a side having lower resistance. In other words, the current flows to the control board 60 via another contact 65*b* arranged in parallel as indicated by an arrow in the drawing. As is known from Ohm's law, the current at this time flows at the same value as when the resistance is not increased. Therefore, a temperature detection signal is correctly transmitted. As a result, the contact 65*a* having the increased resistance becomes unnecessary on the temperature detection circuit, the fixing device 5 operates correctly, and no failure occurs.

Figure 6:
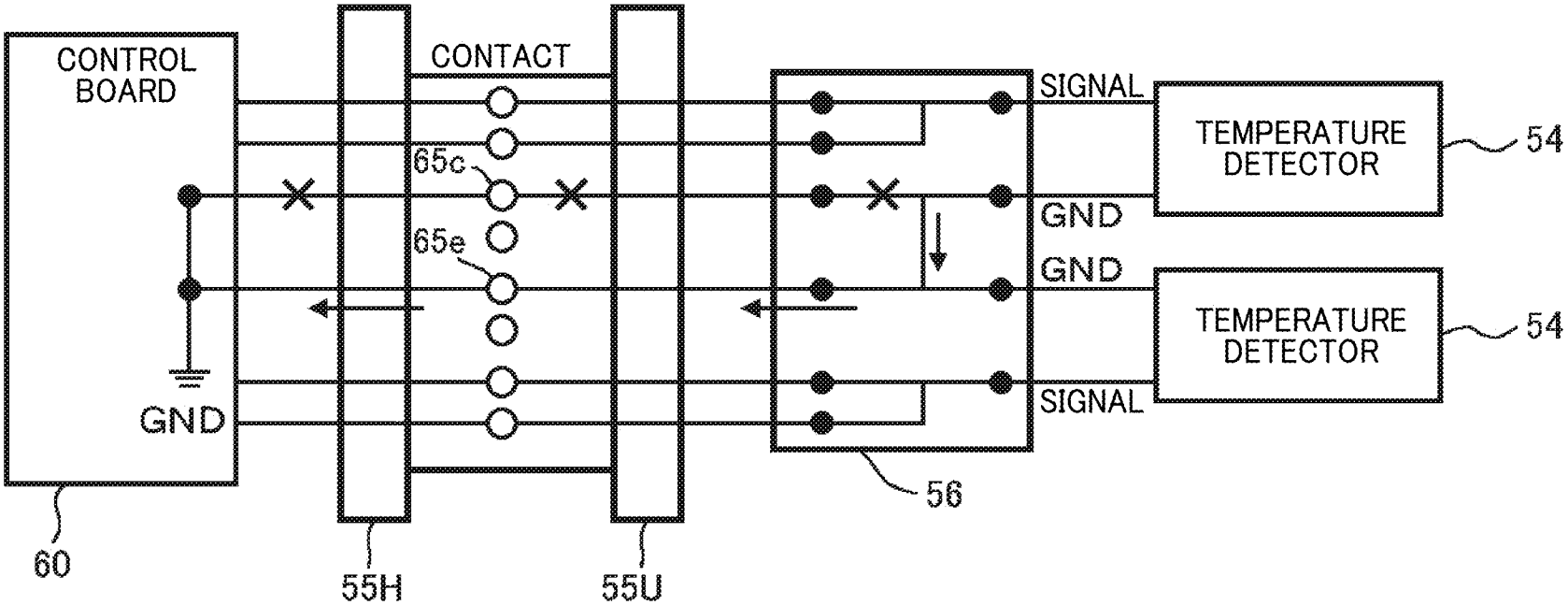
FIG. 6 is a diagram illustrating a temperature detection circuit according to another embodiment of the present disclosure, in which contacts of a drawer connector are schematically illustrated.

FIG. 6 is a diagram illustrating a temperature detection circuit according to another embodiment of the present disclosure, in which contacts 65*c*, 65*e*, etc. between device-side connector 55U and a body-side connector 55H of a drawer connector 55 of FIG. 4 are schematically illustrated. In the present embodiment, a relay board 56 is arranged between a temperature detector 54 and a drawer connector 55, and each temperature detector 54 individually includes a signal wire and a GND wire. The signal wire from each temperature detector 54 is connected to the relay board 56 where the signal wire is branched into two signal wires (in other words, the number of wires is increased to a plurality of wires) and connected to a control board 60 through the drawer connector 55. On the other hand, a plurality of GND wires from the temperature detector 54 are connected to each other by pattern wiring on the relay board 56. The signal wire transmits a signal of a detected temperature, but the GND wires are common and serve as a reference. In this temperature detection circuit, since the plurality of GND wires can be used in common, the GND wires can be connected in parallel at the time of passing through the drawer connector 55. With this parallel connection, even in a case where abnormality occurs at one contact, current flows to a normal contact in a manner similar to the case of the signal wires. Therefore, a temperature can be detected correctly. For example, in the present embodiment, in a case where resistance is increased at a contact 65*c*, the current flows to the control board 60 via another contact 65*e*. Thus, it is possible to prevent occurrence of failure that accompanies abnormality at a contact, and reliability can be improved. With use of the relay board 56, a contact of a GND wire can be freely selected. The number of contacts of the GND wires can be increased/decreased due to constraints in the number of temperature detectors and the number of signals on the drawer connector. Since the signal is transmitted to the drawer connector 55 while using the plurality of GND wires of the temperature detection circuit in common, the above-described effects can be obtained without increasing the number of signal wires used on the drawer connector. Furthermore, since the number of wires is not increased, upsizing of the apparatus can be prevented, and a cost increase can be suppressed. Use of the relay board 56 enables use of the drawer connector 55 that is a versatile drawer connector as having been conventionally used. Therefore, the drawer connector 55 can be procured at a low cost.

Figure 7:
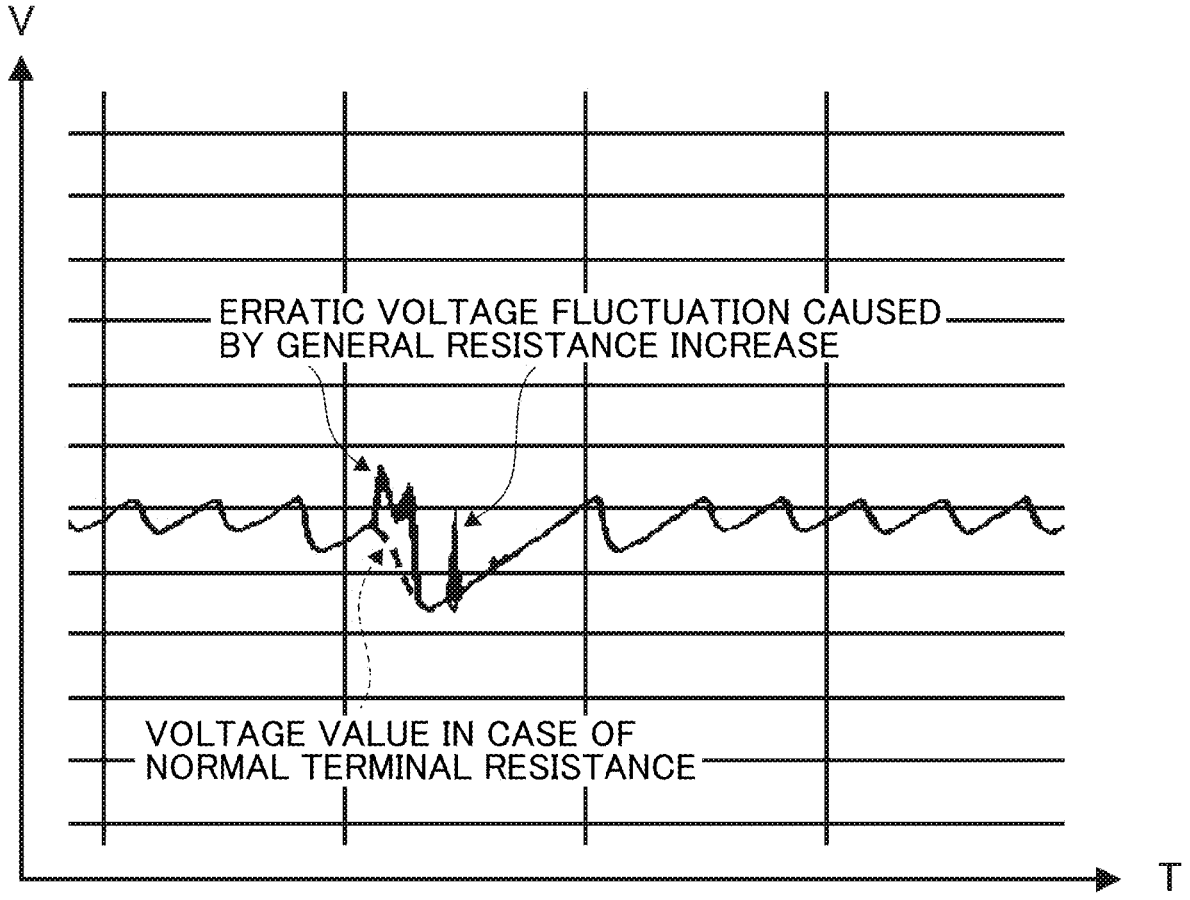
FIG. 7 is a diagram illustrating voltage change that accompanies temperature change of a fixing rotator.

FIG. 7 is a diagram illustrating voltage change that accompanies temperature change of the fixing rotator 51. The controller 61 deems a voltage value as a temperature detection signal, controls the energization of the heating member 53, and controls the fixing rotator 51 to have a constant temperature. Therefore, the voltage value synchronous with the temperature of the fixing rotator 51 is controlled to be a constant value as illustrated. However, in the occurrence of resistance increase at a contact portion, voltage temporarily erratically fluctuates as illustrated in FIG. 7 as a result thereof. Then, as a result of the temporary fluctuation of the temperature detection signal, a target temperature deviates from a correct value. As a result, an entire waveform that has stayed at constant amplitude is also disordered. In occurrence of defective contact caused by a nickel oxide, a contact portion acts extremely unstably, and contact resistance is instantaneously changed or comes to have an intermediate resistance value. However, in most cases, the resistance increase is not continuous, and the resistance returns to a normal state by slight vibration or attachment/detachment of the fixing device 5. In the example of FIG. 7 also, the voltage waveform returns to the normal state after the resistance is increased twice to three times. Therefore, a temperature detection waveform also immediately returns to a waveform corresponding to the constant temperature.

Thus, the resistance is unlikely to continuously fluctuate erratically in the occurrence of defective contact caused by the nickel oxide. Therefore, since the contacts are arranged in parallel, other remaining normal contacts can be used with a high possibility. Consequently, the temperature detection signal can be correctly transmitted. In the image forming apparatus, probability of occurrence of the failure caused by resistance increase at a contact can be largely reduced.

Conversely, in a case where the resistance is continuously increased at a contact, resistance is increased at the plurality of contacts. In this case, the effect of having the plurality of contacts cannot be obtained.

Figure 8A:
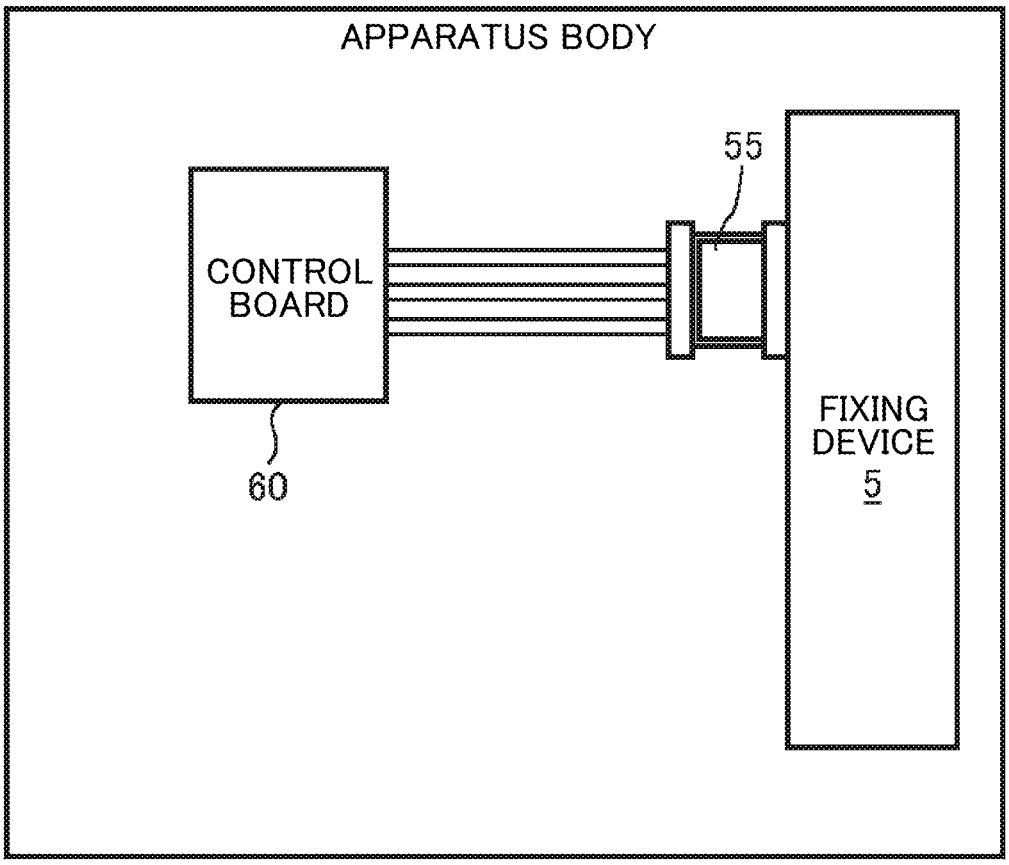
FIG. 8A is a diagram schematically illustrating arrangement of a fixing device and a drawer connector with respect to an apparatus body.
Figure 8B:
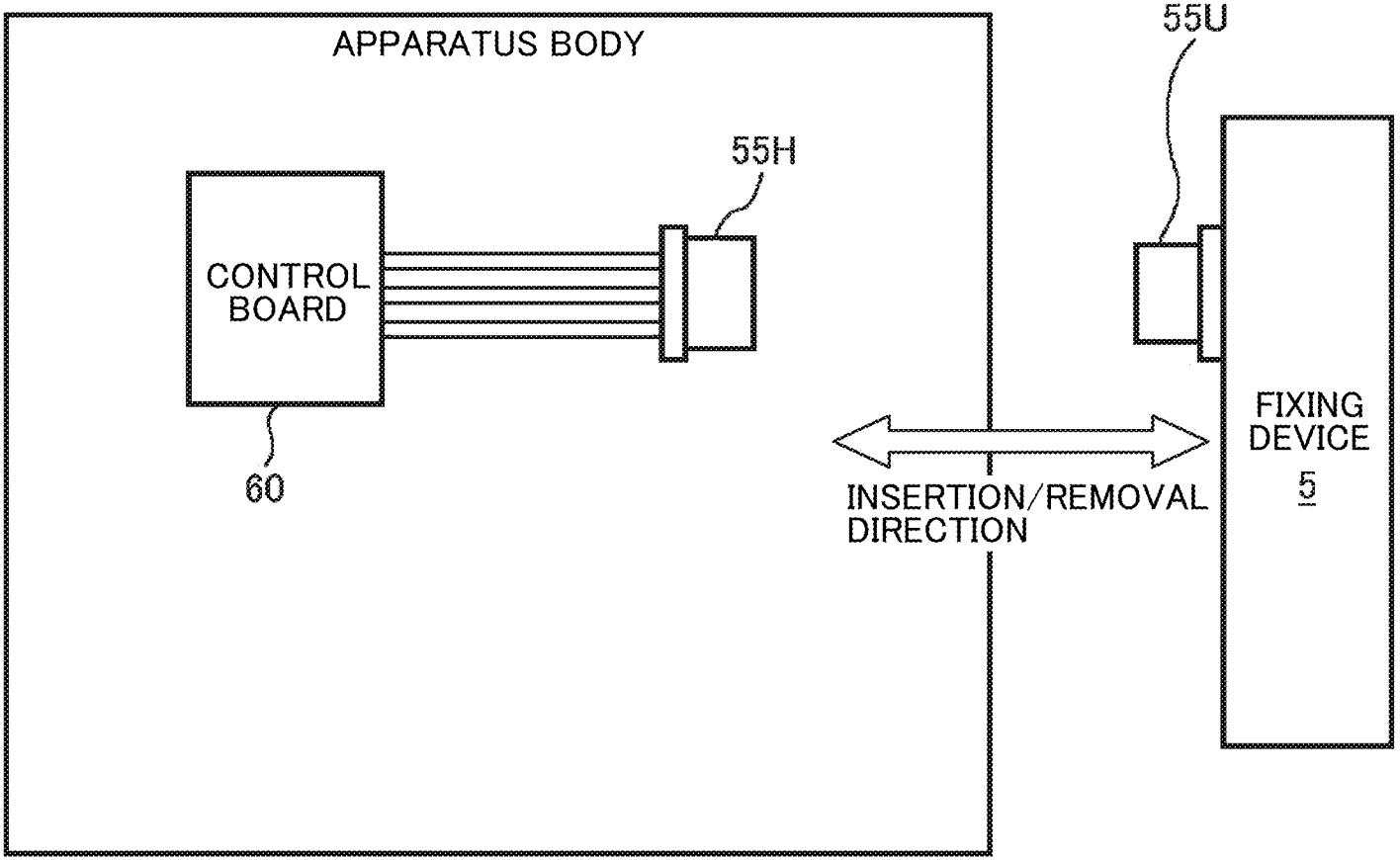
FIG. 8B is a diagram schematically illustrating an attachment/detachment direction of the fixing device.
Figure 8C:
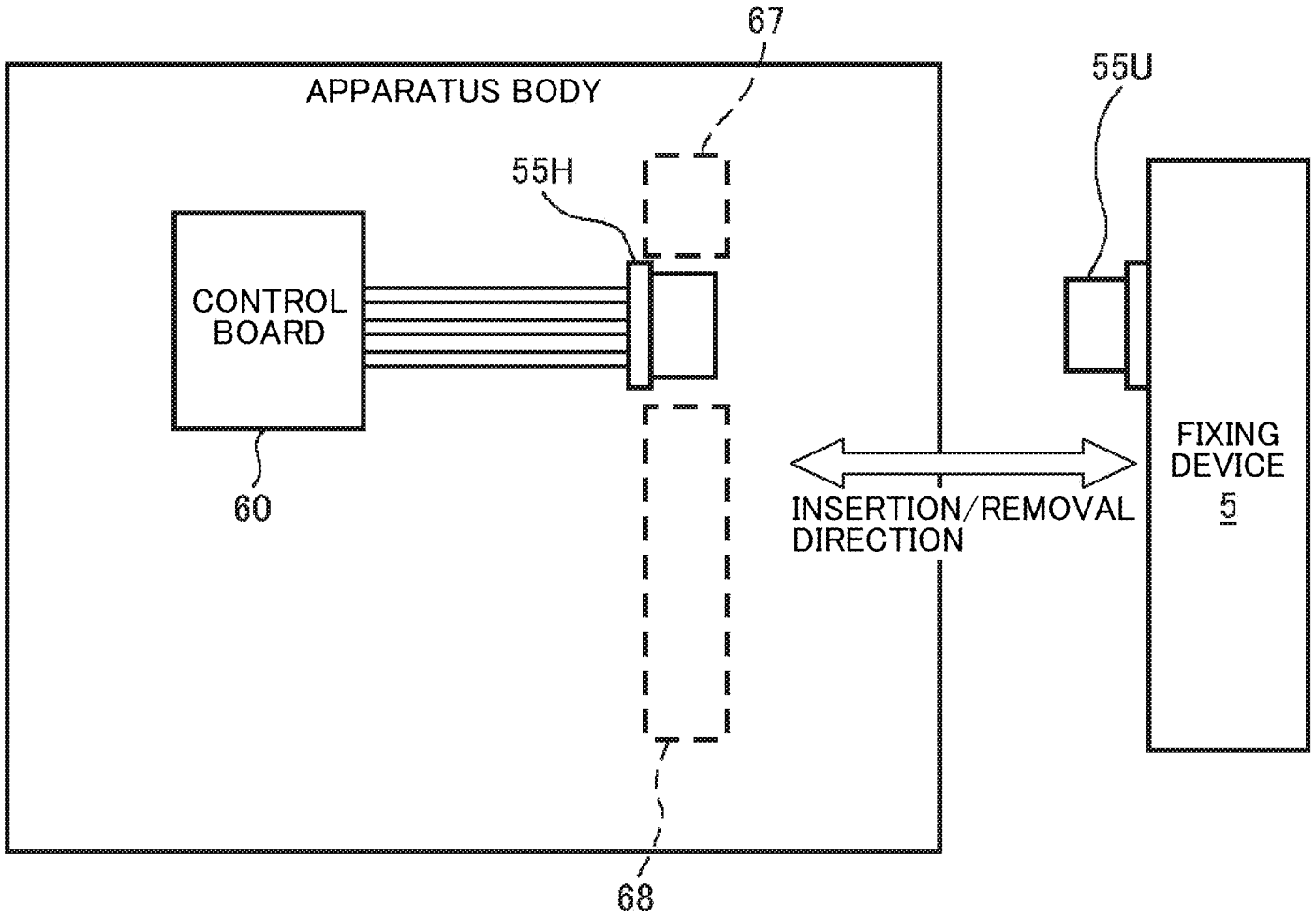
FIG. 8C is a diagram illustrating dead spaces adjacent to the drawer connector.
Figure 8D:
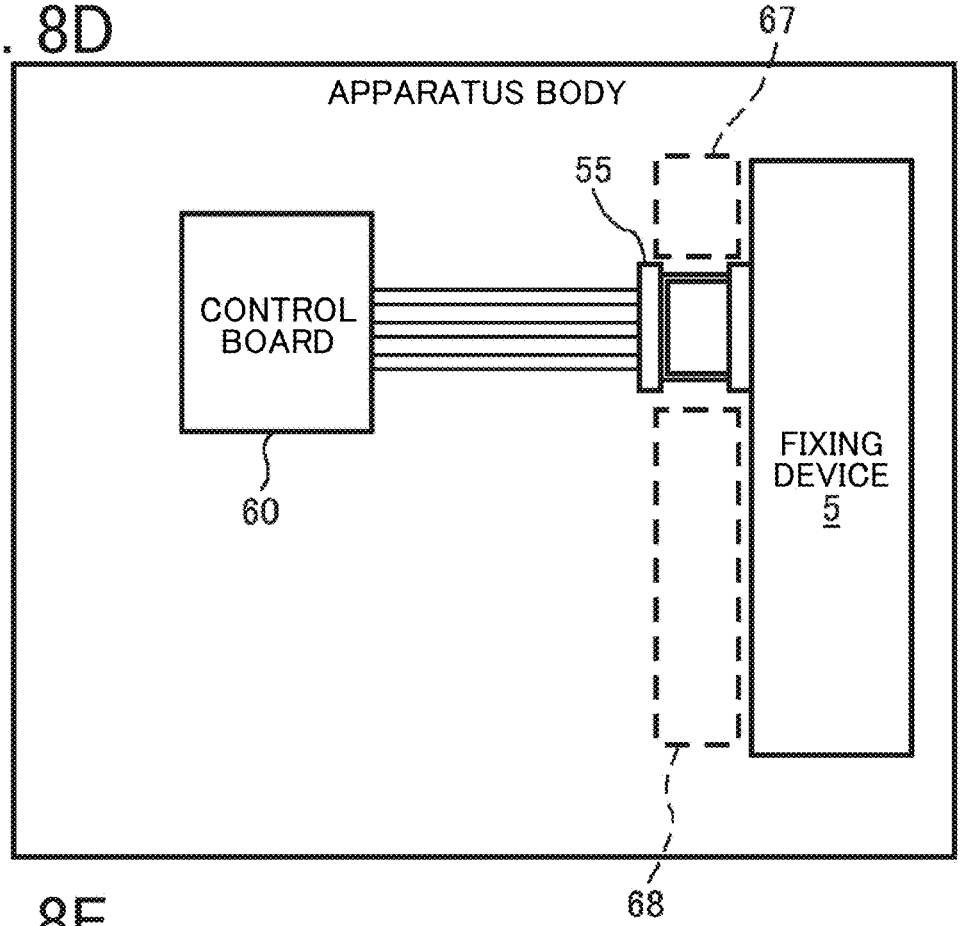
FIG. 8D is a diagram illustrating dead spaces adjacent to the drawer connector.

Next, installation of the relay board 56 will be described. FIGS. 8A to 8E are schematic diagrams illustrating arrangement of the image forming apparatus body and the fixing device 5. FIG. 8A schematically illustrates arrangement of the fixing device 5 and the drawer connector 55 with respect to the apparatus body, and the fixing device 5 is attached to the apparatus body via the drawer connector 55. FIG. 8B schematically illustrates an attachment/detachment direction of the fixing device 5, and the fixing device 5 is attachable/detachable in a direction orthogonal to a longitudinal direction of the fixing device 5. FIG. 8B illustrates the state in which the fixing device 5 is detached from the apparatus body, and the fixing device 5 including the device-side connector 55U and the apparatus body including the body-side connector 55H are separated. In this case, the drawer connector 55 including the device-side connector 55U and the body-side connector 55H are arranged in a manner insertable/removable in the attachment/detachment direction of the fixing device 5. With this arrangement, the drawer connector 55 is inserted/removed synchronously with the attachment/detachment of the fixing device 5 to form/release electrical connection.

Figure 8E:
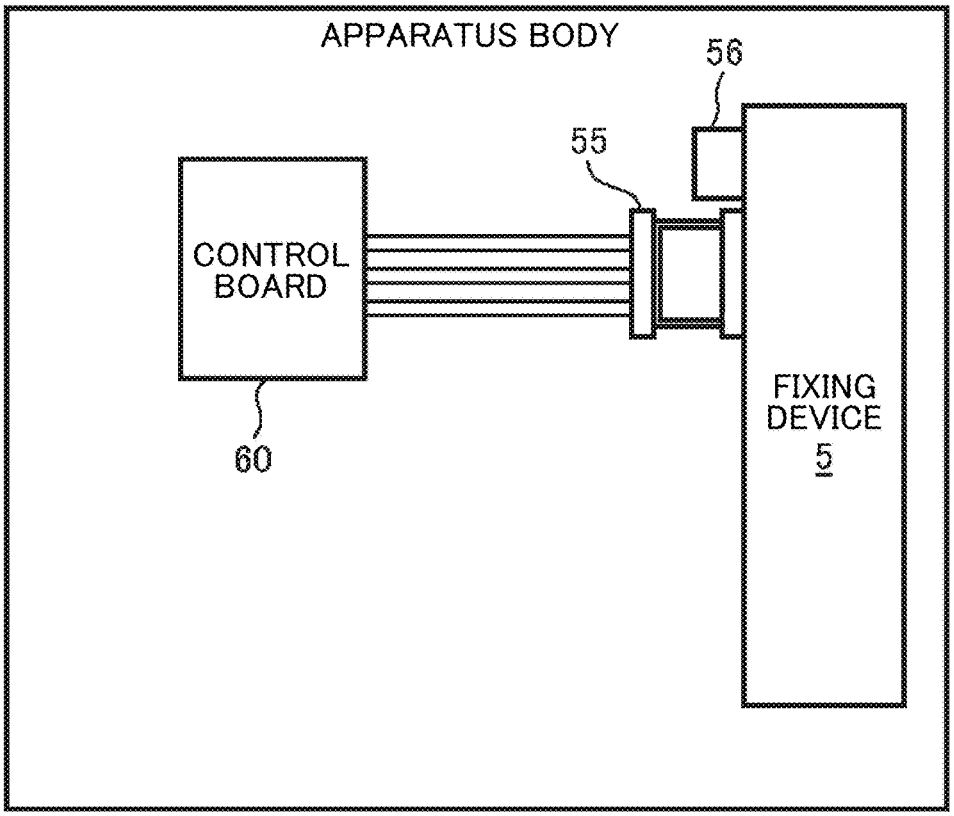
FIG. 8E is a diagram illustrating positions of the dead space and the relay board.

The drawer connector 55 as an electrical component is desirably arranged in a manner so as to minimize influence from heat of the fixing device 5, and it is difficult to arrange the drawer connector 55 inside the fixing device 5 due to its size. Therefore, as illustrated in FIG. 8B, the device-side connector 55U of the drawer connector 55 is arranged in a manner protruding to the outside of the fixing device 5. In this case, as indicated by broken lines in each of FIGS. 8C and 8D, dead spaces 67 and 68 are generated in a width direction adjacent to the body-side connector 55H that is the protruding portion of the drawer connector 55. The dead spaces 67 and 68 do not contribute to the attachment/detachment of the fixing device 5 and are not suitable for arranging another component having an approximately same width as that of the drawer connector 55. There may be a case where the dead spaces 67 and 68 are used as buffer spaces to prevent heat conduction from the fixing device 5 to the apparatus body, or used as airflow paths in the apparatus. However, the dead spaces hinder downsizing of the apparatus. Considering this, the relay board 56 is arranged on the fixing device 5 at a place corresponding to the dead space 67 as illustrated in FIG. 8E. As a result, the dead space 67 is effectively used, and the relay board 56 can be arranged without upsizing the apparatus. Alternatively, the relay board 56 may be arranged on the fixing device 5 at a place corresponding to the dead space 68.

Additionally, since the relay board 56 and the drawer connector 55 are connected with a wiring harness, it is preferable that the relay board 56 be arranged near the drawer connector 55.

Figure 9A:
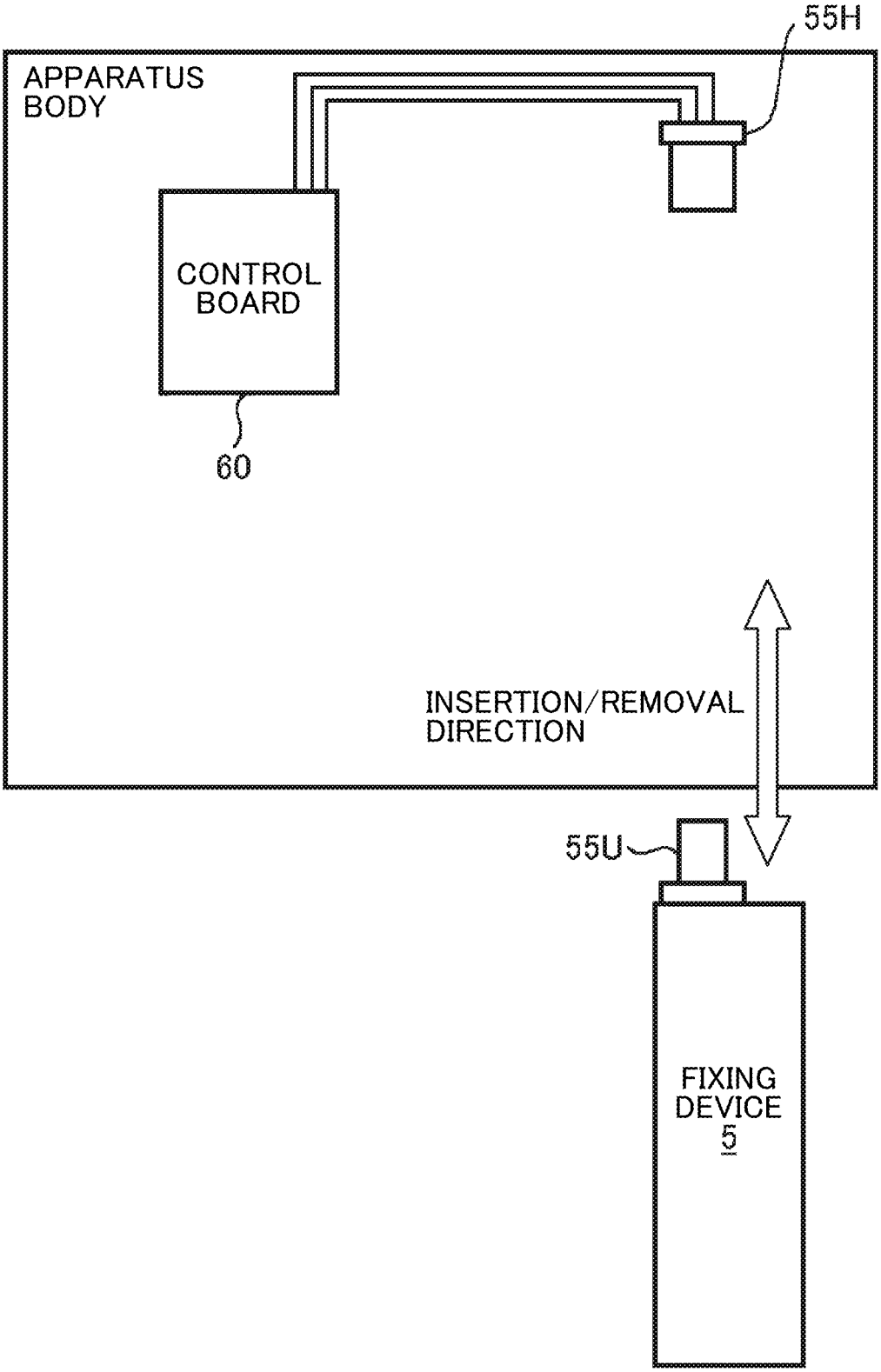
FIG. 9A is a schematic diagram illustrating another arrangement of the image forming apparatus body and the fixing device.
Figure 9B:
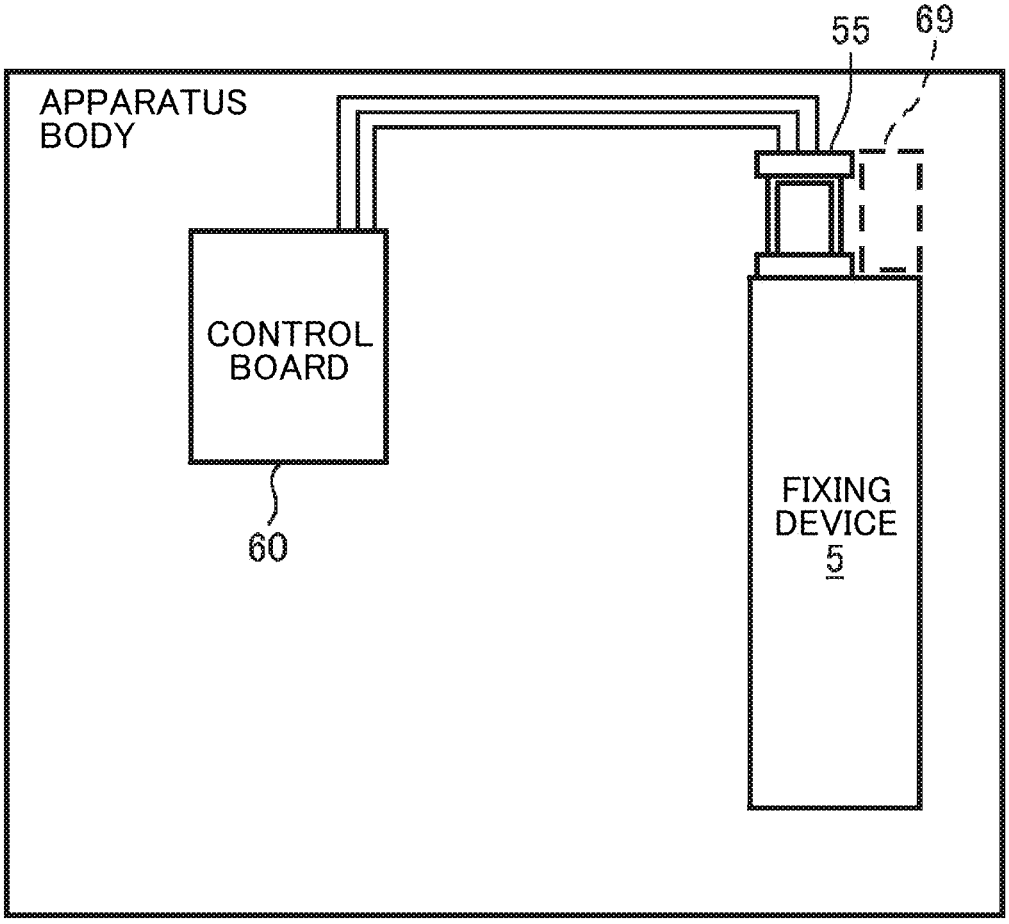
FIG. 9B is a schematic diagram illustrating still another arrangement of the image forming apparatus body and the fixing device.

FIGS. 9A and 9B are schematic diagrams illustrating other types of arrangement of the image forming apparatus body and the fixing device. In FIG. 9A, the fixing device 5 is detached from the apparatus body. In FIG. 9B, the fixing device 5 is attached to the apparatus body via the drawer connector 55. In the present embodiment, the fixing device 5 is detachable in the longitudinal direction of the fixing device. Therefore, the device-side connector 55U is arranged at an end portion in the longitudinal direction of the fixing device 5. The drawer connector 55 including the device-side connector 55U and the body-side connector 55H is arranged in a manner insertable/removable in the attachment/detachment direction of the fixing device 5. As illustrated in FIG. 9B, a dead space 69 is generated beside the drawer connector 55 when the fixing device 5 is attached. Therefore, the relay board 56 is arranged on the fixing device 5 at a place corresponding to the dead space 69.

Figure 10:
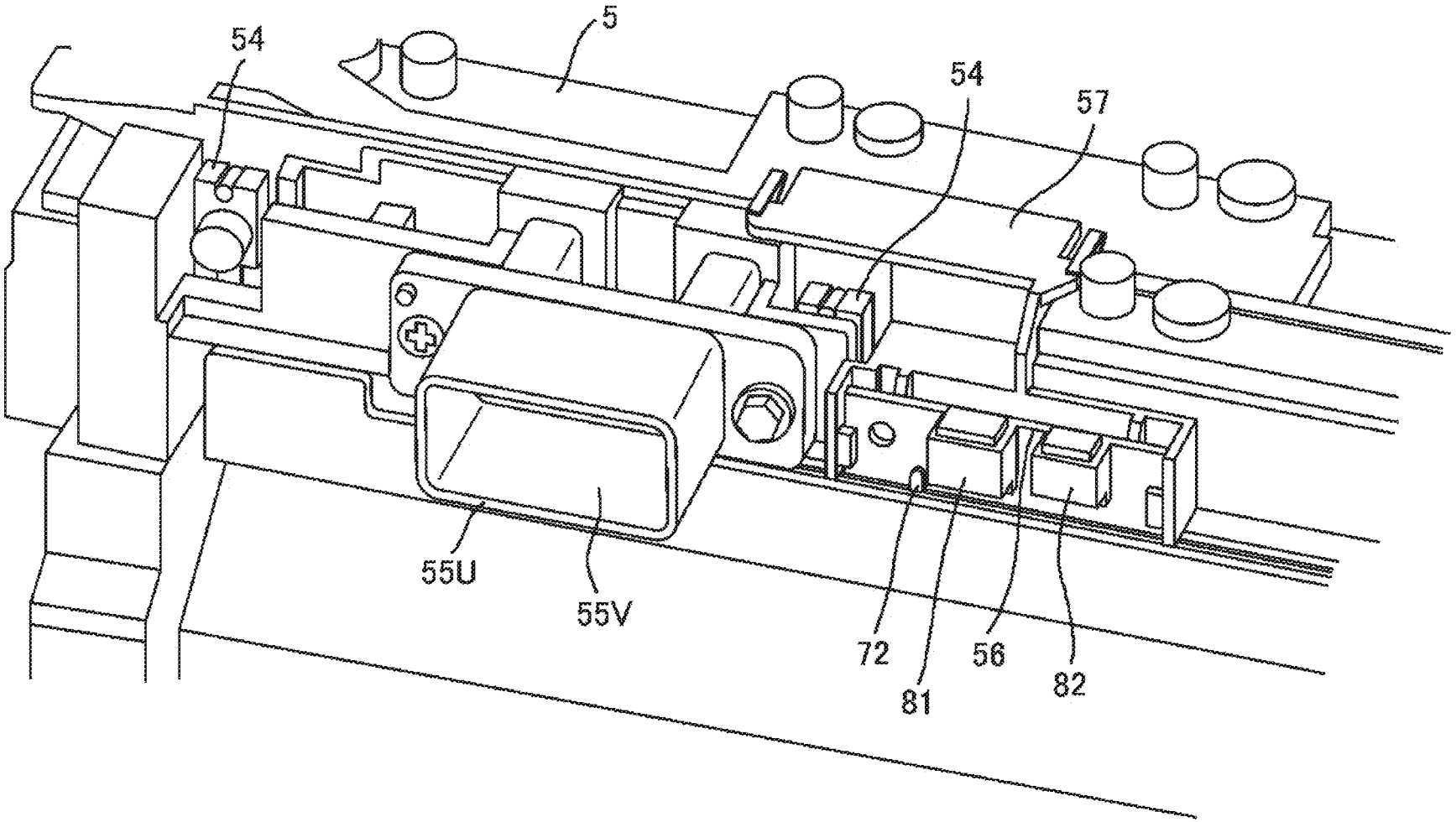
FIG. 10 is a schematic rear perspective view of the fixing device according to the embodiment.

FIG. 10 is a schematic rear perspective view of the fixing device 5 according to the embodiment. The device-side connector 55U is fixed above and behind the fixing device 5. The device-side connector 55U includes a rectangular opening 55V and includes a gold-plated terminal inside of the device-side connector 55U. The body-side connector 55H has a shape corresponding to the rectangular opening 55V and also includes a gold-plated terminal inside of the body-side connector 55H. The terminal on the device-side connector 55U side comes in contact with the terminal on the body-side connector 55H side, thereby forming the electrical connection. The temperature detector 54 is installed in the fixing device 5. The temperature detector 54 includes: an end-portion thermistor installed at an end portion in the longitudinal direction of the fixing device 5; and a central thermistor installed at a center portion of the fixing device. Next to the device-side connector 55U, a resin holder 57 is fixed to the fixing device 5, and the relay board 56 is arranged on the resin holder 57.

The relay board 56 is held at the fixing device 5 as illustrated. Since the relay board 56 is provided in the fixing device 5, the drawer connector 55, which is a versatile drawer connector as having been conventionally used, can be used. Therefore, the drawer connector 55 can be procured at a low cost, and it is possible to prevent upsizing and a cost increase caused by using a complex shape in the drawer connector 55. Furthermore, since the relay board 56 can be arranged without relevance to the drawer connector 55, flexibility in arrangement is enhanced inside the fixing device 5 without affecting the apparatus body.

Additionally, as illustrated, the relay board 56 is held by the resin holder 57 included in the fixing device 5. The use of the resin holder 57 can provide the following advantages.

Figure 11:
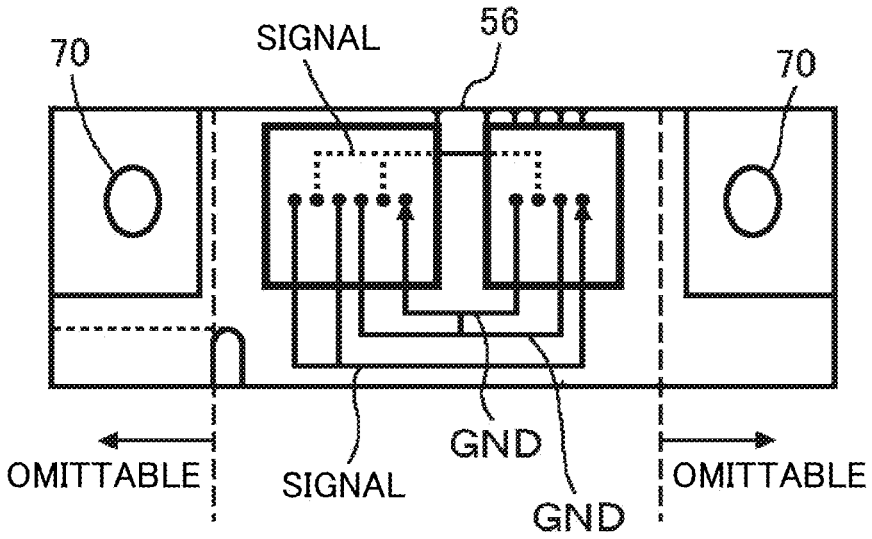
FIG. 11 is a schematic configuration diagram of the relay board.

- The resin member has better thermal insulation and lower thermal conductivity than a metal member does. As a result, the heat from the fixing rotator 51 is hardly conducted to the relay board 56, the relay board 56 is protected from the heat, and stable operation can be ensured.
- Since the resin member has an insulation property, there is no concern of electrical short circuit or erroneous operation caused by the short circuit. Therefore, there is high flexibility in arrangement, for example, in mounting components and the like.
- The resin member has high flexibility in a shape, and formation of a mounting shape is facilitated. The relay board 56 can be installed in the resin member (holder 57) without using a fixture such as a screw. Therefore, not only the insulation property can be obtained but also assemblability is improved. Additionally, as illustrated in FIG. 11, since it is not necessary to include a screw mounting shape, a portion including a screw hole 70 of the relay board 56 can be omitted. Thus, the relay board 56 can be downsized.

Here, FIG. 11 is a schematic configuration diagram of the relay board 56. In the relay board 56 illustrated in FIG. 11, a signal wire is branched into two signal wires (in other words, the number of signal wires is increased to a plurality of wires) in a manner similar to the relay board 56 illustrated in FIG. 6. On the other hand, GND wires are connected to each other.

Figure 12:
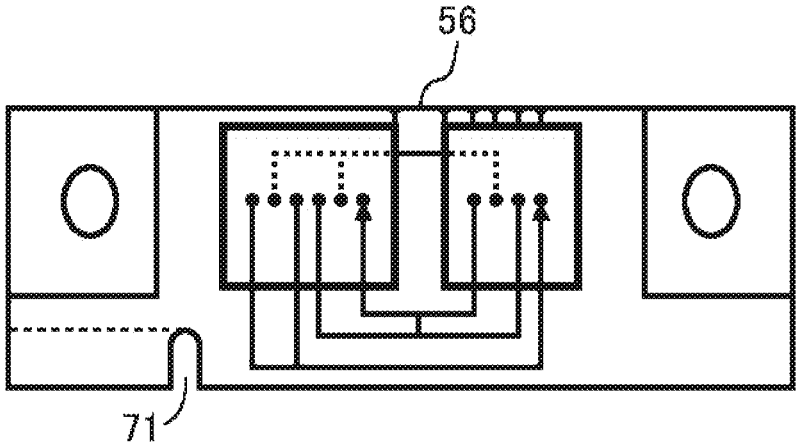
FIG. 12 is a schematic configuration diagram of the relay board.

FIG. 12 is a schematic configuration diagram of the relay board 56. As illustrated, a cutout 71 is provided at a lower portion of the relay board 56. On the other hand, as illustrated in FIG. 10, the resin holder 57 included in the fixing device 5 includes a projection 72 to be fitted into the cutout 71. The projection 72 of the fixing device 5 is thus fitted into the cutout 71 of the relay board 56, thereby uniquely determining a direction in which the relay board 56 is held at the fixing device 5. With this configuration, stable assemblability can be obtained in distributing and arranging the lead wires (wiring harness), fitting the connectors, and the like, and incidental defective assembly can be reduced.

Furthermore, as illustrated in FIG. 10, it is preferable that each of connectors 81 and 82 into which the relay board 56 is inserted have a structure that prevents erroneous insertion of the relay board 56. Thus, the stable assemblability can be obtained in fitting the connectors, and the like, and incidental defective assembly can be reduced. Specifically, types of the respective connectors may be different types, and the number of pins in each of the connectors 81 and 82 may be different from each other, such as six pins and four pins, respectively.

Figure 13:
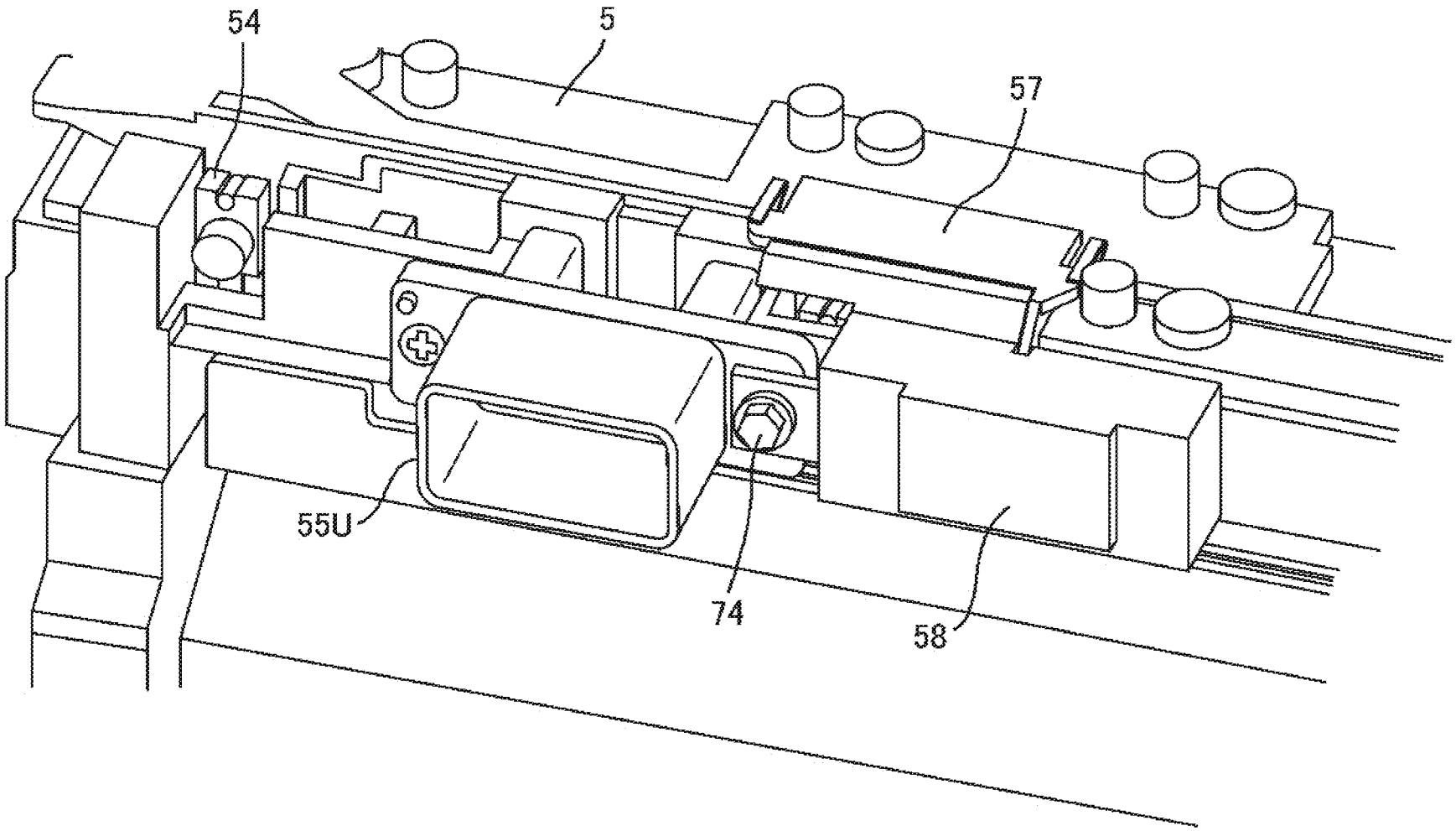
FIG. 13 is a view illustrating an embodiment of a cover that covers the relay board.

FIG. 13 is a diagram illustrating an embodiment of a cover 58 that covers the relay board 56. As illustrated, the relay board 56 is covered with the cover 58 in the fixing device 5 of the present embodiment. The cover 58 covers the entire relay board 56. With this configuration, when the fixing device 5 is attached or detached, an operator or a service person is prevented from unintentionally contacting the relay board 56 of the fixing device 5 that has been taken out from the apparatus. Furthermore, troubles such as mechanical damage to a component, electrical damage caused by static electricity and the like, disconnection of a connector, and the like can be prevented.

Additionally, the device-side connector 55U of the drawer connector 55 and the cover 58 are both fastened to the fixing device 5 by a fastener 74. With this configuration, assemblability is more simplified and the number of components can be reduced. The fastener 74 is, for example, a bolt.

Figure 14:
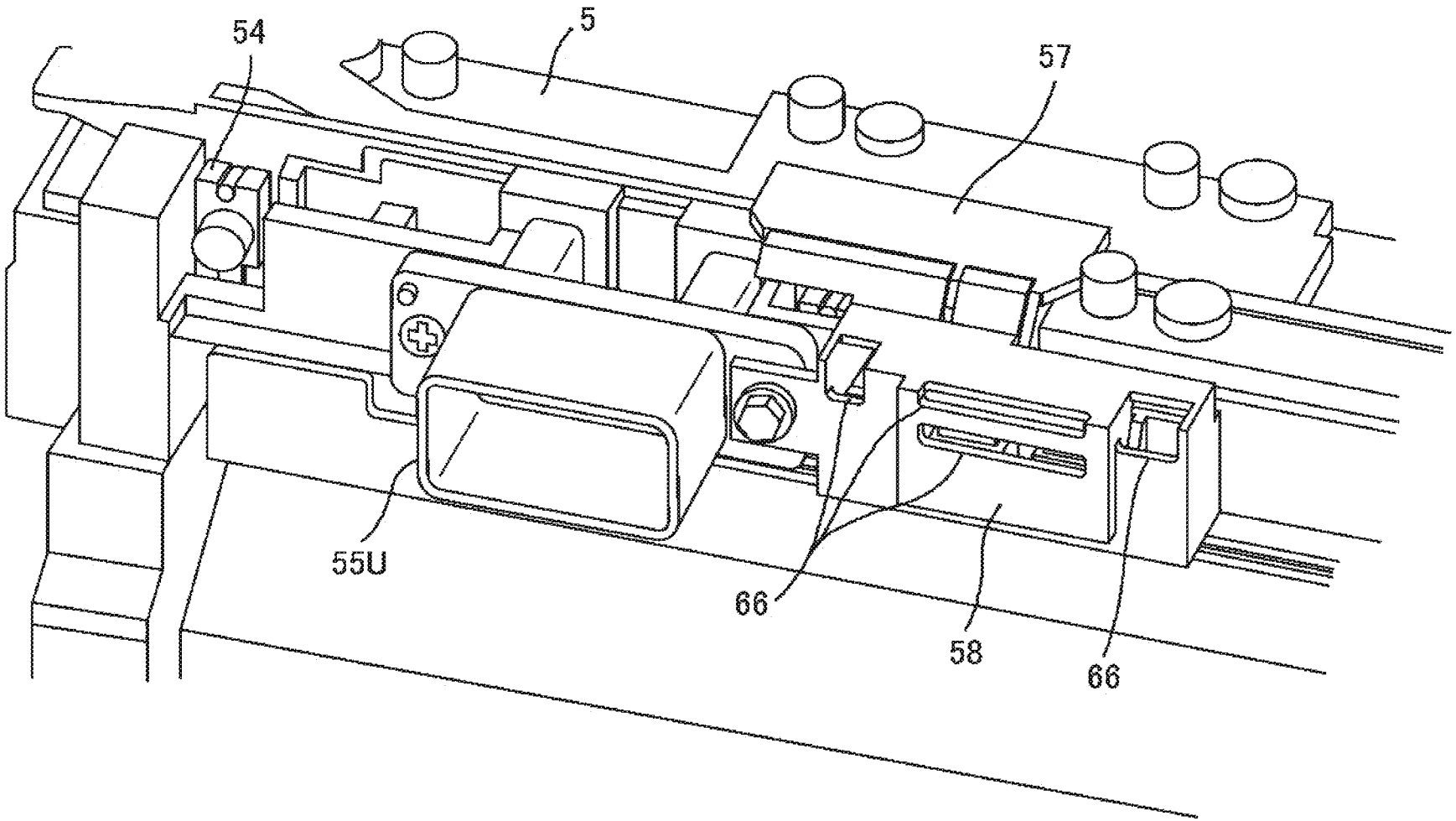
FIG. 14 is a view illustrating another embodiment of a cover that covers a relay board.

FIG. 14 is a view illustrating another embodiment of a cover 58 that covers a relay board 56. As illustrated, the cover 58 includes a plurality of openings 66. This structure provides the following effects.

An operator or a service person can easily visually confirm that the relay board 56 is correctly assembled and arranged, and it is possible to reduce assembly errors and solve a problem early at the time of malfunction.

The openings 66 on the cover 58 improve ventilation of the relay board 56.

Therefore, it is possible to suppress temperature increase in the relay board 56 that is arranged in the vicinity of a fixing rotator 51 and has a temperature tending to be high.

Additionally, it is preferable that the cover 58 and a holder 57 have a guide shape to guide lead wires (wiring harness). With this configuration, the lead wires can be distributed and arranged in the guide shape, and the incidental defective assembly can be reduced.

Figure 15A:
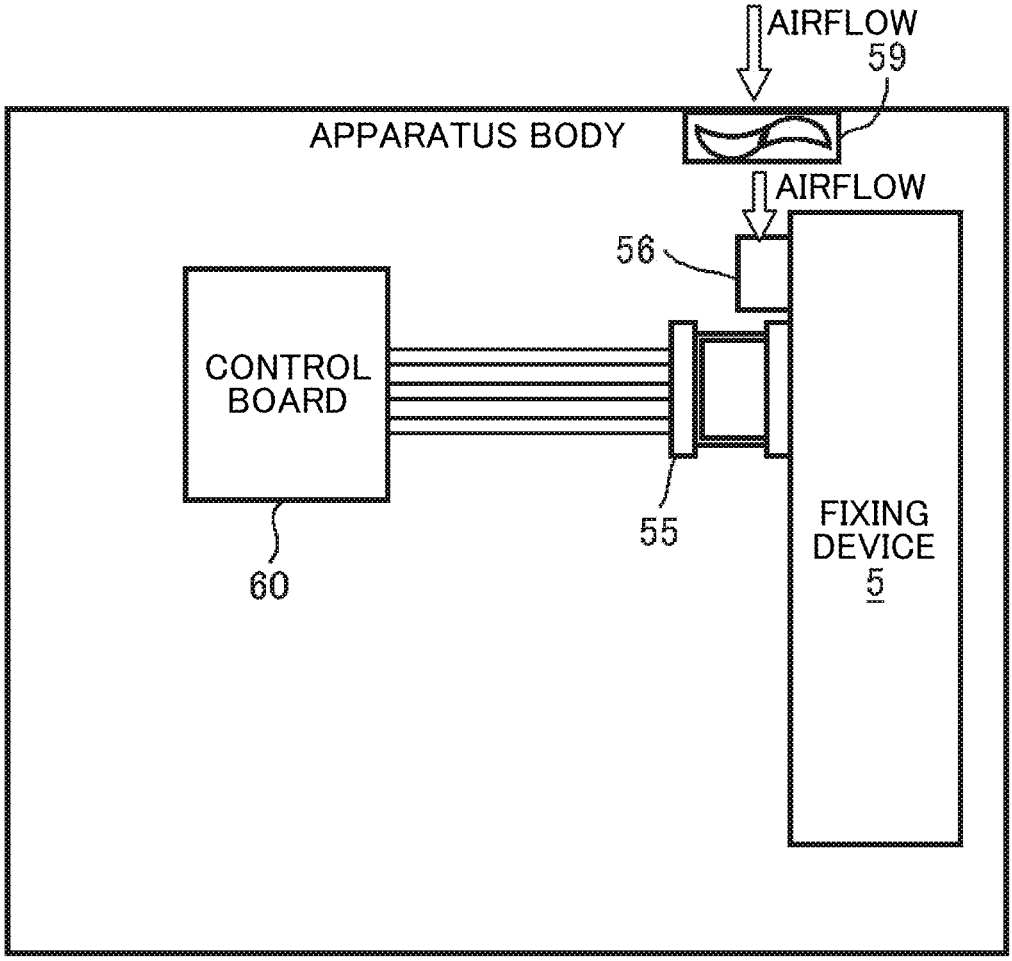
FIG. 15A is a diagram illustrating an airflow in the apparatus and arrangement of the relay board.
Figure 15B:
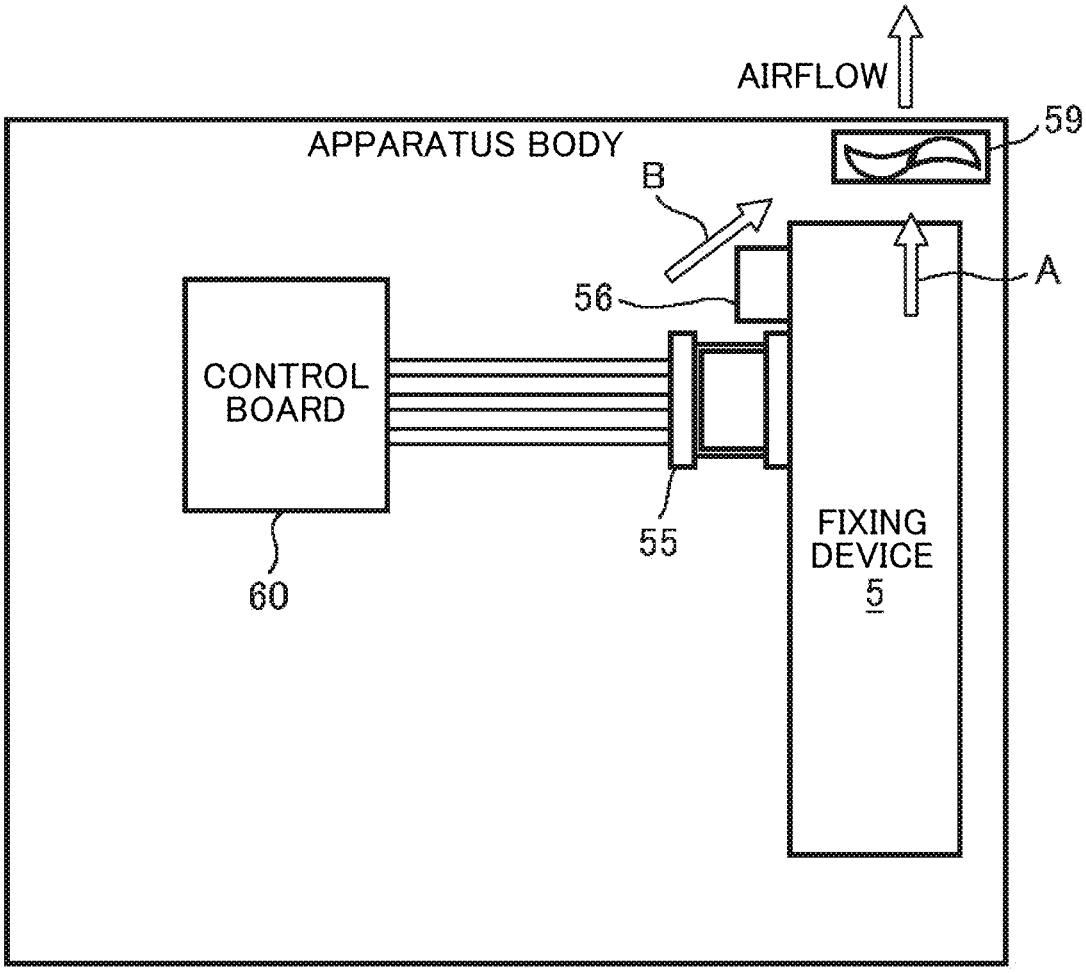
FIG. 15B is a diagram illustrating an airflow in the apparatus and arrangement of the relay board.

FIGS. 15A and 15B are diagrams illustrating an airflow in the apparatus and arrangement of the relay board 56. FIG. 15A is the diagram of the embodiment illustrating a state in which a fan 59 sucks the airflow into the apparatus. The relay board 56 is arranged on an airflow path in the image forming apparatus. Specifically, the fan 59 is arranged behind the relay board 56, and the relay board 56 is arranged such that the fan 59 can receive the airflow sucked from the outside of the apparatus as indicated by arrows. The airflow has a temperature equivalent to a temperature outside the apparatus. In the present embodiment, the temperature increase in the relay board 56 caused by the heat of the fixing device 5 is suppressed by the airflow from the outside of the apparatus, and stable operation of the relay board 56 can be ensured.

FIG. 15B is a diagram of another embodiment illustrating a state in which a fan 59 exhausts an airflow to the outside of an apparatus. At this time, the fan 59 is arranged behind the fixing device 5 in the apparatus and forms an airflow to exhaust heat in the vicinity of the fixing device 5 to the outside of the apparatus as indicated by a flow path A. This flow path A is a flow path to transfer the heat of the fixing device 5 from an upstream side to a downstream side (near the fan 59). In a case where a relay board 56 is arranged on this flow path A, the heat of the fixing device 5 concentrates on the relay hoard 56. To suppress the temperature increase in the relay board 56, such heat concentration is not preferable. On the other hand, a temperature of the airflow indicated by a flow path B and flowing from a place other than the fixing device 5 in the apparatus is low. Therefore, the relay board 56 is arranged on the flow path B, thereby reducing the influence of the heat from the fixing device 5 on the relay board 56 even though the relay board 56 is arranged in the vicinity of the fixing device 5. Thus, the relay board 56 is arranged on the airflow path in the image forming apparatus.

As described above, according to embodiments of the present disclosure, the contacts in the drawer connector are arranged in parallel. Therefore, even in occurrence of defective contact caused by contact resistance abnormality at one contact, a temperature detection signal can be correctly transmitted to the apparatus body by another contact having normal electrical continuity and arranged in parallel. As described above, since this kind of resistance increase is not continuous, there is extremely little possibility that the resistance increase occurs simultaneously at the plurality of contacts arranged in parallel. As a result, it is possible to prevent occurrence of failure that accompanies abnormal temperature detection of the apparatus.

For example, it is conceivable to use a special connector like a conventional art in order to have such a plurality of contacts. However, since the special connector is not versatile, there may be various constraints in a size, a shape, ease of procurement, a cost, and the like of the connector. For example, a drawer connector includes a male connector and a female connector, and the male connector is in contact with the female connector at two contact portions on upper and lower sides. Such a drawer connector includes the two contact portions for a line of one system, but to solve the problem, it is necessary to manufacture a special drawer connector. As a result, different problems may be caused as described below.

In other words, since it is necessary to manufacture a connector having a special specification, there is no versatility and a connector conforming to apparatus specifications cannot be adopted. For example, in a case where usage is limited by insufficiency in the required number of signal wires and insufficiency in the number of power supply wires, or conversely, in a case where there are signal wires and power supply wires more than necessary, there may be constraints in a size and the like.

According to the embodiments of the present disclosure, for example, the relay board is provided in the fixing device and temperature detection signals are made parallel in the relay board. Consequently, signal wires can be arranged in parallel while using the versatile drawer connector. The relay board is arranged in the fixing device, and the number of signals is increased/decreased in the relay board. Consequently, it is possible to downsize the entire apparatus without affecting the apparatus body.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A fixing device comprising:

at least one temperature detector configured to detect a temperature of the fixing device; and a device-side connector configured to transmit a temperature detection signal from the at least one temperature detector to an image forming apparatus body by mutual contact between a terminal of the device-side connector and a terminal of a body-side connector of the image forming apparatus body, wherein a lead wire of the at least one temperature detector is branched into a plurality of wires connected to the device-side connector.

2. The fixing device according to claim 1, wherein the plurality of wires include a plurality of ground wires from the at least one temperature detector, wherein the plurality of ground wires are connected to each other.

3. The fixing device according to claim 2, wherein a relay board is disposed between the at least one temperature detector and the device-side connector, wherein the plurality of ground wires, from the at least one temperature detector, are connected to each other by pattern wiring on the relay board.

4. The fixing device according to claim 1, wherein a relay board is disposed between the at least one temperature detector and the device-side connector, wherein the lead wire of the at least one temperature detector is branched into the plurality of wires by pattern wiring on the relay board.

5. The fixing device according to claim 4, wherein the relay board is held at the fixing device.

6. The fixing device according to claim 5, further comprising a holder holding the relay board, wherein the holder is made of resin.

7. The fixing device according to claim 6, wherein the holder is shaped to hold the relay board without using a fixture.

8. The fixing device according to claim 6, wherein the relay board includes a cutout, wherein the holder includes a projection fitted with the cutout.

9. The fixing device according to claim 6, further comprising a cover covering the relay board.

10. The fixing device according to claim 9, wherein the cover includes an opening.

11. The fixing device according to claim 9, wherein the cover and the holder have a guide shape to guide the lead wire.

12. The fixing device according to claim 9, further comprising a fastener to fasten the device-side connector and the cover together to the fixing device.

13. The fixing device according to claim 4, further comprising a connector into which the relay board is inserted, wherein the connector has a structure that prevents erroneous insertion of the relay board.

14. The fixing device according to claim 4, wherein the relay board is configured to be arranged on an airflow path in an image forming apparatus.

15. An image forming apparatus comprising the fixing device according to claim 1.

* * * * *